US007390272B2

(12) United States Patent
Kasashima et al.

(10) Patent No.: US 7,390,272 B2
(45) Date of Patent: Jun. 24, 2008

(54) GOLF BALL

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 40 days.

(21) Appl. No.: 11/477,445

(22) Filed: Jun. 30, 2006

(65) Prior Publication Data

US 2008/0004136 A1 Jan. 3, 2008

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 6,290,615 B1 9/2001 Ogg
7,018,309 B2 3/2006 Kasashima et al.
7,128,666 B2 * 10/2006 Veilleux et al. ..... 473/384
2003/0158002 A1 * 8/2003 Morgan et al. ..... 473/383
2006/0068939 A1 3/2006 Sato et al.

FOREIGN PATENT DOCUMENTS

JP 2005-319292 A 11/2005
JP 2006-95281 A 11/2005

* cited by examiner

*Primary Examiner*—Raeann Trimiew
(74) *Attorney, Agent, or Firm*—Sughrue Mion, PLLC

(57) ABSTRACT

The invention provides a golf ball with a ball surface having a plurality of non-circular dimples thereon, wherein mutually neighboring dimples have contour lines therebetween which are arranged so as to be substantially parallel and are separated by an interval of 0.05 to 1.0 mm, land areas defined by the substantially parallel contour lines have an outer surface which forms the outermost peripheral face of the ball, and the non-circular dimples have a non-circular shape with inside angles that are curved. This arrangement endows the ball with a distinctive, aesthetically pleasing appearance on account of the dimple pattern composed largely of non-circular dimples. Moreover, even though numerous non-circular dimples are arranged on the surface of the ball, the high surface coverage and air resistance-lowering effect enable the distance traveled by the ball to be increased.

20 Claims, 3 Drawing Sheets

GOLF BALL

BACKGROUND OF THE INVENTION

The present invention relates to a golf ball on the surface of which many of the dimples formed are of non-circular shape, which golf ball has an excellent flight performance.

For a golf ball which has been hit to travel a long distance, it is important that the ball itself have a high rebound and that air resistance during flight be reduced by dimples arranged on the surface of the ball. A variety of methods for arranging dimples uniformly and to the highest possible density on the surface of the ball have been proposed in order to reduce the air resistance.

Here, the commonly employed dimple shape is a recess that is circular as seen from directly above. Because such circular dimples are used, attempts to arrange circular dimples to a high density, such as by making the width of the land between two neighboring circular dimples as close to zero as possible, result in the formation of triangular or quadrangular lands of a given size in areas surrounded by three or four of the arranged dimples. At the same time, it is essential to arrange the dimples as uniformly as possible on the spherical surface of the ball. Hence, a certain degree of compromise concerning the density in the arrangement of circular dimples has been necessary.

It is in such a context that, to arrange the dimples on a golf ball uniformly and to a high density, from two to ten types of dimples of differing diameter are disposed in such a way as to give the spherical surface of the ball the appearance of a regular octahedron or a regular icosahedron.

However, so long as circular dimples are used, the practical upper limit in the dimple surface coverage, defined as the ratio of the sum of the individual dimple surface areas to the total surface area of the spherical surface, is about 75% (that is, the surface coverage represented by the composite surface area of the lands is about 25%).

U.S. Pat. No. 6,290,615 describes a golf ball in which the land surface area has been reduced by providing, unlike the aforementioned dimples, projections (lattice members) that extend in a lattice over the smooth spherical surface and divide the surface into small hexagonal regions.

However, the small hexagonal regions demarcated by the lattice members are spherical surfaces having centers which coincide with the center of the ball and, because they are not dimples, are disadvantageous in terms of their air resistance-lowering effect.

In this connection, the present applicant has disclosed in U.S. Pat. No. 7,018,309 (corresponding Japanese application: JP-A 2005-319292) a golf ball having formed thereon, between mutually neighboring non-circular dimples, numerous narrow-width edge elements that serve as portions of the dimple edges, thereby increasing the dimple coverage on the surface of the ball and enhancing the air resistance-lowering effect.

However, in these existing golf balls, the presence of acutely or obtusely angled corners in the non-circular dimples having, for example, a polygonal shape as seen from above increases frictional resistance with air, resulting in a less than satisfactory improvement in the distance traveled by the ball.

Moreover, the present applicant has disclosed the dimples described in JP-A 2006-95281. Yet, in addition to an increase in the distance of travel, there is also a need for good moldability and practical improvements in the dimples.

SUMMARY OF THE INVENTION

It is therefore an object of the present invention to provide a golf ball which, by enhancing the aerodynamic performance due to the dimple effect, is able to increase the distance traveled by the ball.

Accordingly, the invention provides a golf ball comprising a ball surface having a plurality of non-circular dimples thereon, wherein mutually neighboring dimples have contour lines therebetween which are arranged so as to be substantially parallel and are separated by an interval of 0.05 to 1.0 mm, land areas defined by the substantially parallel contour lines have an outer surface which forms the outermost peripheral face of the ball, and the non-circular dimples have a non-circular shape with inside corners that are curved.

The invention also provides, as preferred embodiments, the foregoing golf ball of the invention wherein a plurality of circular dimples is present on the ball surface; wherein the non-circular dimples having a non-circular shape with curved inside angles have, in the smallest curved portions thereof, a radius of curvature in a range of 0.1 to 3.0 mm; which has a dimple surface coverage, based on the surface area of the ball, of at least 75%; and wherein the dimples on the ball surface have a cumulative volume, obtained by summing the volumes of the individual dimples below a flat plane circumscribed by the edge of each dimple, of from 500 to 750 $mm^3$.

In the present invention, by having most of the dimples formed on the surface of the ball be non-circular dimples, by having the contour lines between mutually neighboring dimples arranged so as to be substantially parallel and narrowly spaced, by having the outer surface of the lands defined by the substantially parallel contour lines coincide with the outermost peripheral face of the ball, and by finishing the inside angles of the non-circular shapes of the non-circular dimples as curves, the surface coverage by the dimples composed primarily of non-circular dimples is increased and the acutely or obtusely angled corners exhibited by the non-circular dimples are smoothly formed, imparting an air resistance-lowering effect which enables the ball to travel a longer distance.

BRIEF DESCRIPTION OF THE DIAGRAMS

DETAILED DESCRIPTION OF THE INVENTION

Figure 1:
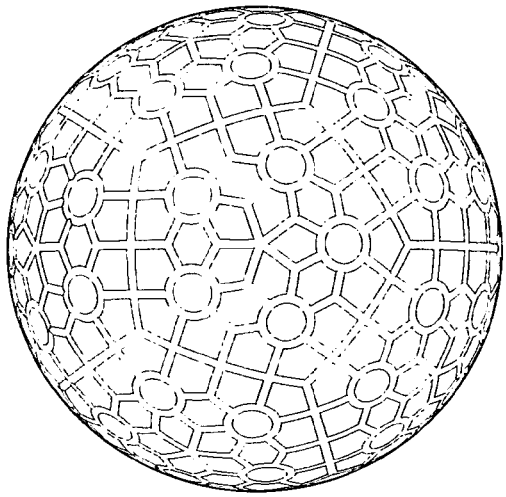
FIG. 1 is a front view showing the dimple pattern in one embodiment of the golf ball of the invention.

The invention is described more fully below.

The golf ball of the invention has a ball surface with a plurality of non-circular dimples present thereon. In the inventive golf ball, the surface coverage of the dimples relative to the surface of the ball is increased by arranging, with regard to the surface of the ball between one dimple and another dimple, the contour lines for both neighboring dimples so as to be substantially parallel.

Network-like or lattice-like lands defined by the substantially parallel contour lines are present between neighboring dimples. The width of these lands, i.e., the width between the substantially parallel contour lines, is adjusted within a range of preferably 0.05 to 1.0 mm, and more preferably 0.1 to 0.8 mm. If the interval has too narrow a width, the dimple will tend to deform easily at the time of impact. Conversely, if the interval is too wide, the surface coverage of the dimples will decrease, diminishing the flight performance of the ball.

In the practice of the invention, the non-circular dimples have a non-circular shape with inside angles that are curved. In a non-circular dimple having a polygonal shape, due to the shape of the corners which correspond to the inside angles of the polygon, the surface lacks smoothness. As a result, the frictional resistance with air increases, preventing the distance traveled by the ball from increasing. Hence, in this invention, the corners of the polygonal dimples are finished to curved surfaces having a specific radius of curvature R. These curved areas do not have a uniform curvature. The radius of curvature R of the smallest portion thereof, while not particularly limited, is adjusted within a range of preferably 0.1 to 5.0 mm, and more preferably 1.0 to 3.0 mm.

When corners of the above-described polygonal dimples are conferred with a specific radius of curvature R, if the curved portions are formed so as to be too large, the surface area of the lands which adjoin these curved portions and where a plurality of dimple edges converge becomes excessive, making it difficult to increase the dimple surface coverage, which is an object of the invention. Hence, it is preferable to form the above lands in a surface area size within which a circle having a diameter of about 2 mm will not fit.

In the present invention, the outer surface of the lands defined by the substantially parallel contour lines forms the outermost peripheral face of the ball. This has the advantage of making the outermost peripheral surface of the ball scratch-resistant.

The total number of dimples formed on the surface of the ball is generally at least 100, and preferably at least 250, but generally not more than 500, and preferably not more than 450.

Non-circular dimple shapes (shapes in a top plan view) that may be used in the invention include polygonal shapes, such as substantially triangular, substantially quadrangular, substantially pentagonal, substantially hexagonal and substantially heptagonal shapes, as well as other, irregular shapes. Any one or suitable combination thereof may be used.

Circular dimples may also be present on the surface of the ball together with such non-circular dimples. The presence of circular dimples enables lift in the low-speed region making up the latter half of the ball's trajectory to be improved.

The number of circular dimples, while not subject to any particular limitation, may be adjusted to a ratio of at least 2% but not more than 50% of the total number of dimples. Mixing circular dimples among groups of non-circular dimples improves lift in the low-speed region and imparts an air resistance-lowering effect. In this case, it is essential for the dimple edges adjoining the circular dimples to be curved. Moreover, it is desirable for at least about four but not more than about seven non-circular dimples to be present around a circular dimple.

The dimples formed on the surface of the ball are arranged in a pattern which may be a regular polyhedral arrangement, such as a spherical dodecahedral, spherical icosahedral, spherical octahedral, spherical hexahedral or spherical tetrahedral arrangement. Use can also be made of a method in which a hemispherical surface is divided into from 3 to 12 equal portions by meridians which intersect the equator from one pole of the ball, and dimples are uniformly arranged within the spherical triangles thus defined.

In the present invention, because the edges making up part of the contour of the non-circular dimples and the inside surface (recessed face) of the non-circular dimple are as described above, the narrow-width lands can be arranged in the form of a network or lattice on the surface of the ball, enabling the surface coverage by the dimples to be increased. The surface coverage by the dimples, based on the surface area of the ball, is preferably at least 75%, more preferably at least 78%, and even more preferably at least 81%.

The dimples have a cumulative volume, obtained by summing the volumes of the individual dimples enclosed between the imaginary sphere were the ball to have no dimples on its surface and the dimple recesses, of preferably from 400 to 750 $mm^3$, and more preferably from 500 to 700 $mm^3$.

The volume of the dimples as a proportion of the total volume of the ball, expressed as the ratio of the cumulative volume of the dimples enclosed between the imaginary sphere were the ball to have no dimples on its surface and the dimple recesses to the volume of the imaginary sphere were the ball to have no dimples on its surface (dimple spatial occupancy), may be set in a range of generally at least 1.1% but not more than 1.7%, and preferably at least 1.2% but not more than 1.6%.

Fabricating a mold for the above-described golf ball using a machine tool equipped with a 3D CAD/CAM system is easy. The mold can be inexpensively fabricated by cutting it out directly using a numerically controlled machine tool running on a program created with 3D CAD/CAM software. The tool preferably uses a ball-nosed end mill. When shaping particularly difficult-to-cut dimple-forming projections in the vicinity of the parting line or the equator, it is possible to cut the deep recesses of the projections by using a ball-nosed end mill in which the cutter portion formed at the working end of the mill has a trajectory during rotation which extends spherically from the axis of rotation or exhibits a virtual shape during rotation that is spherical. Accordingly, use can be made of a three-axis machine having an x-axis, y-axis and z-axis, and having a spindle on which a tool such as a ball-nosed end mill rotates. If the cutter teeth have a radius of about 0.5 to 1.5 mm, during the machining of projections in the vicinity of the parting line, the cutter can be effectively used even when the projections have a complex shape.

In the present invention, when CAD is used to create a shape corresponding to a single non-circular dimple, it is possible to have the single non-circular dimple be composed of, in the CAD data, a set of a plurality of 6 to 20 sides which are radially divided from the center of the non-circular dimple.

The interior construction of the ball is not subject to any particular limitation. That is, the invention may be employed in any type of golf ball, including solid golf balls such as one-piece golf balls, two-piece golf balls, and multi-piece golf balls having a construction of three or more layers, or thread-wound golf balls. For example, suitable use can be made of a multi-layer construction composed of a resilient solid core, a cover, and one or more intermediate layer disposed therebetween. Ball specifications such as the ball weight and diameter may be set as appropriate in accordance with the Rules of Golf.

EXAMPLES

Examples of the invention are given below by way of illustration, and not by way of limitation.

First Embodiment

The golf ball of the invention is described more fully below in conjunction with the attached diagrams.

Figure 2:
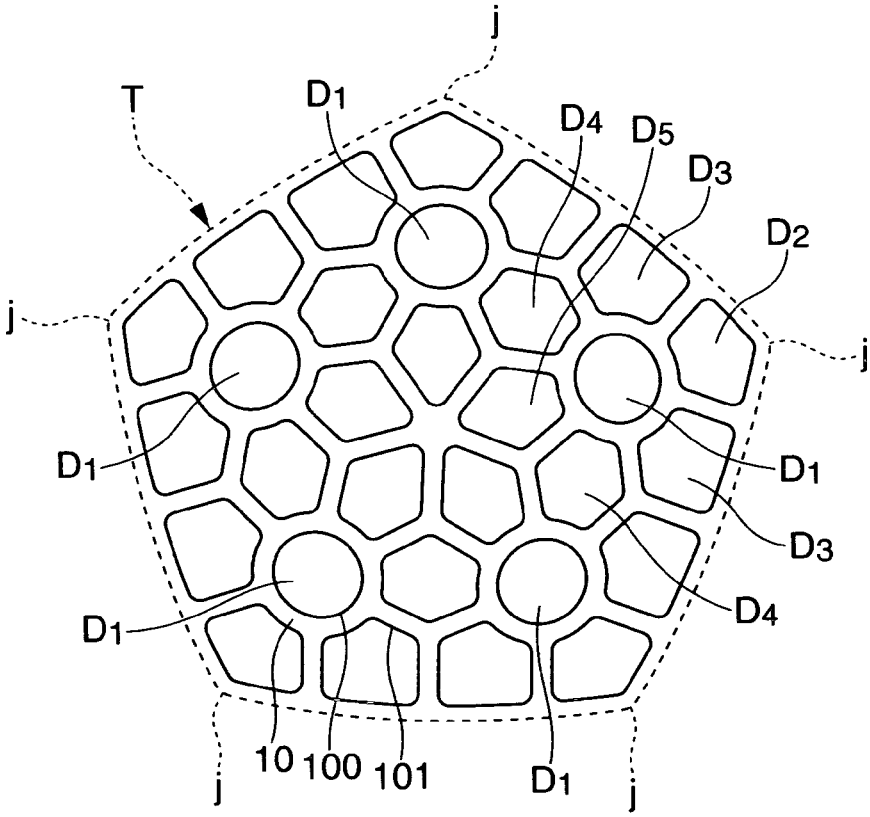
FIG. 2 is a partially enlarged view of the surface of the ball shown in FIG. 1.

FIG. 1 is a top view showing a golf ball illustrating a first embodiment of the invention, and FIG. 2 is a partially enlarged view of the same ball. As shown in FIG. 1, this golf ball exhibits a plurality of circular dimples and non-circular dimples formed in a distinctive arrangement on the surface of the ball.

This golf ball has a dimple arrangement based on a spherical dodecahedron composed of unit pentagons T inside the five vertices of which are disposed circular dimples $D_1$. Referring to FIG. 2, six polygonal dimples $D_2$, $D_3$, $D_3$, $D_4$, $D_4$ and $D_5$ are arrayed about one such circular dimple $D_1$. The edges of the respective polygonal dimples which adjoin the circular dimple $D_1$ exhibit circularly arcuate shapes that are parallel to circular arcs of the circular dimple $D_1$. In the diagram, the symbol 100 represents the edge of the circular dimple, and the symbol 101 represents the edge of a polygonal dimple. The contour lines of the respective polygonal dimples have a geometric pattern which becomes apparent when the peripheral edges of each dimple are viewed from directly above.

The polygonal dimples are described while referring to FIG. 2. A substantially pentagonal dimple $D_2$ is situated at the corner of a vertex j of the unit pentagon T, and two substantially pentagonal dimples $D_3$ and $D_3$ are situated along both edges of the unit pentagon T on either side of the vertex j. Two substantially hexagonal dimples $D_4$ and $D_4$ are respectively situated adjacent to one of the substantially pentagonal dimples $D_3$ and $D_3$ and between the above circular dimple $D_1$ and another circular dimple $D_1$. In addition, a substantially pentagonal dimple $D_5$ is situated on a side opposite from the vertex j of the unit pentagon T across the circular dimple $D_1$. This substantially pentagonal dimple $D_5$, has a distinctive, substantially petal-like shape with one pointed end.

In the golf ball of the above first embodiment, a total of 30 dimples are arranged within the unit pentagon T: five circular dimples $D_1$, five substantially pentagonal dimples $D_2$, ten substantially pentagonal dimples $D_3$, five substantially hexagonal dimples $D_4$, and five substantially pentagonal dimples $D_5$. The total number of dimples on the golf ball is thus 360, of which 60 (about 17% of the total number) are circular dimples.

Figure 3:
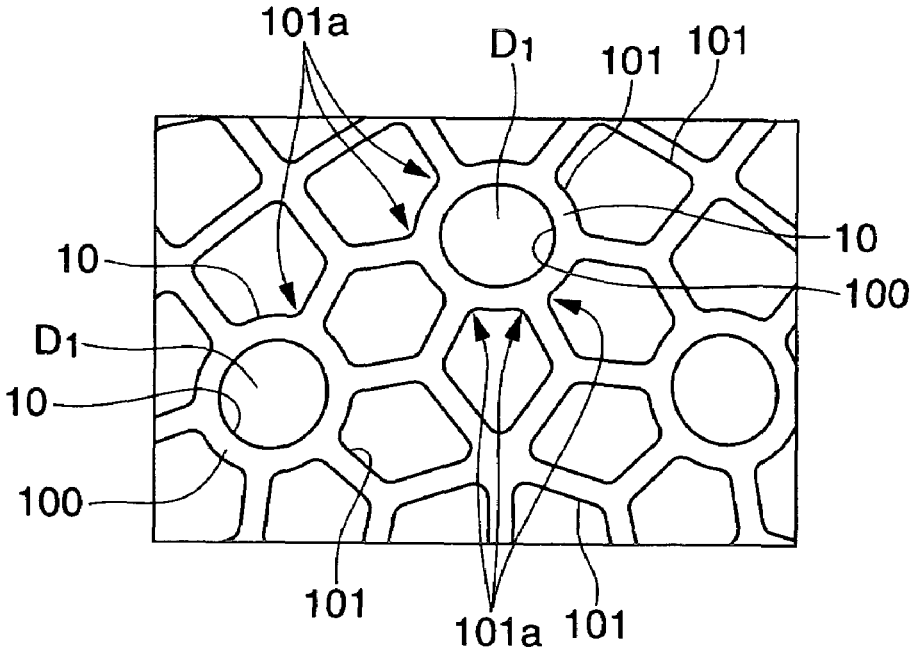
FIG. 3 illustrates the shapes of the inner surfaces of the dimples shown in FIG. 1.

Moreover, in the golf ball of this embodiment, looking in particular at the inside surface (recessed face) of each dimple, as shown in FIG. 3, the corners at the edges 101 of the polygonal dimple are formed into smoothly curved areas 101*a*. These curved areas have a radius of curvature R which has been set within the above-indicated range. By having the inside surfaces of the dimples composed of curved surfaces in this way, the air resistance can be reduced.

In the golf ball of this embodiment, the surface coverage of the dimples with respect to the surface area of the ball is about 80%, and the total volume of the dimples is 530 $mm^3$.

Figure 6:
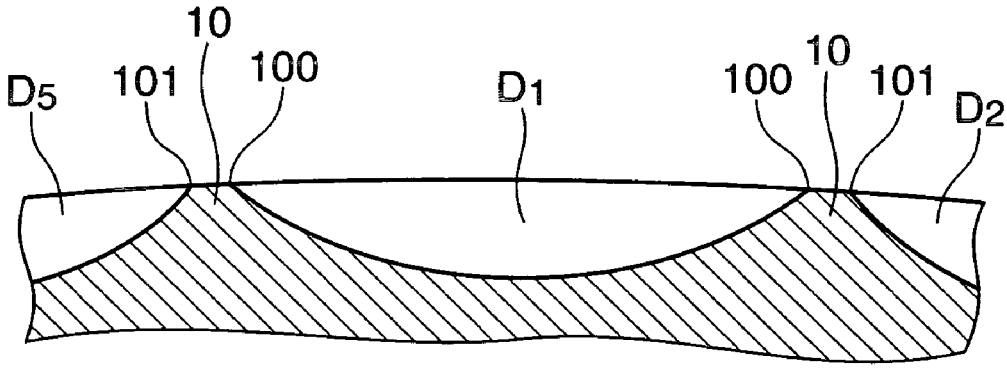
FIG. 6 is a partial cross-sectional view showing the relative arrangement of dimples and lands near the surface of the ball.

FIG. 6 is a cross-sectional diagram of dimples and lands on the surface of the ball. The edges of the circular dimple $D_1$ are indicated by the symbol 100, and the edges of the non-circular dimples $D_2$ and $D_5$ adjacent to this dimple are indicated by the symbols 101 and 101. As already noted, both of these edges 100 and 101, when seen from above, appear as substantially parallel contour lines. In FIG. 6, the lands 10 are defined by the substantially parallel contour lines. Moreover, the outside surfaces of these lands 10 coincide with the outermost peripheral face of the ball.

The diameter of the circular dimple $D_1$ is represented by a line segment that passes through the center point of the dimple and connects both edges 100 and 100. This diameter is 4.3 mm, and the depth of the dimple is 0.15 mm.

Second Embodiment

Figure 4:
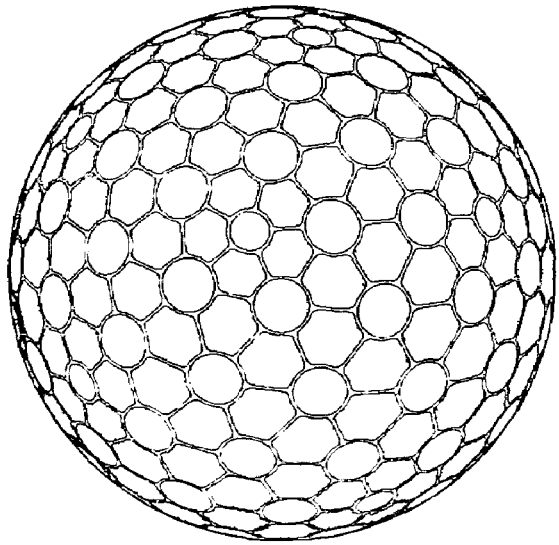
FIG. 4 is a front view showing the dimple pattern in a second embodiment of the golf ball of the invention.
Figure 5:
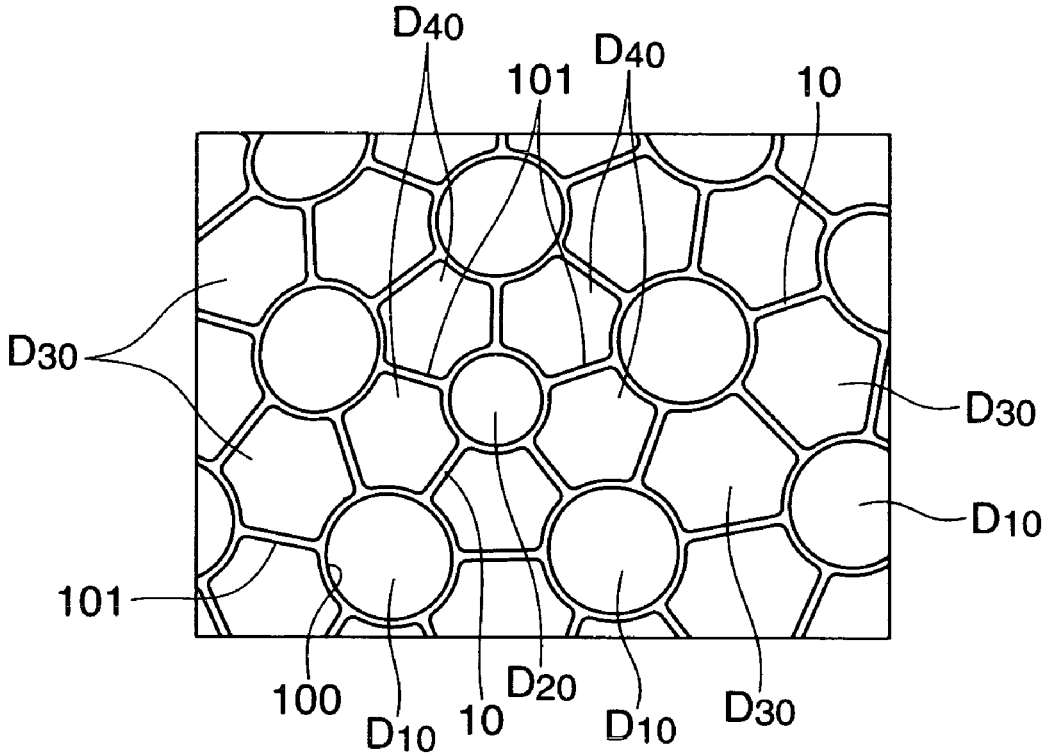
FIG. 5 illustrates the shapes of the inner surfaces of the dimples shown in FIG. 4.

FIG. 4 shows the dimple arrangement pattern on a second embodiment of the inventive golf ball. At first glance, the dimples arranged on the surface of the ball all appear to be circular, providing an aesthetically pleasing appearance that does not feel strange compared with conventional golf balls on which all the dimples are circular. However, in the present invention, six non-circular dimples are always arranged around a circular dimple, and there are no mutually neighboring circular dimples. That is, the circular dimples used on the golf ball of this second embodiment are of two types, one ($D_{10}$) having a large diameter of 4.3 mm and the other ($D_{20}$) having a small diameter of 3.3 mm. As shown in FIG. 5, a pair of substantially hexagonal dimples $D_{40}$ and $D_{40}$ are disposed between a large-diameter circular dimple $D_{10}$ and a small-diameter circular dimple $D_{20}$ so as to fill the intervening gap. A slender, narrow-width land 10 is formed between the large-diameter circular dimples $D_{10}$ and the small-diameter circular dimples $D_{20}$ so as to connect them. By making the edges 101 and 101 of the mutually opposed substantially hexagonal dimples $D_{40}$ and $D_{40}$ parallel, the lands 10 exhibit a slender, rod-like shape.

Situated between any two large-diameter circular dimples $D_{10}$ are a pair of dimples $D_{30}$ which are slightly larger than the substantially hexagonal dimples $D_{40}$. By making the edges of these dimples $D_{30}$ mutually parallel, a slender, narrow-width land 10 is formed so as to connect the circular dimples $D_{10}$, and $D_{10}$.

In this second embodiment, the contour lines between mutually adjoining dimples are always arranged so as to be substantially parallel. For example, between a circular dimple $D_{10}$ and a non-circular dimple $D_{30}$, the edge 101 of the non-circular dimple $D_{30}$ is formed in a circularly arcuate shape so as to be parallel with the circularly arcuate shape of the edge 100 of the adjoining circular dimple $D_{10}$.

As in the first embodiment, the outside surfaces of the lands 10 in this second embodiment coincide with the outermost peripheral surface of the ball, as shown in FIG. 6.

Moreover, in this second embodiment, by forming the places on the inside surfaces of the substantially hexagonal dimples $D_{30}$ and $D_{40}$ that serve as the corners of the respective dimples into curves, the circular dimples and the non-circular dimples are successfully harmonized, improving the aesthetic balance between the circular dimples and the non-circular dimples (substantially hexagonal dimples).

The total number of dimples in this embodiment is 326, of which 110 are circular dimples (approximately 34% of the total number).

In the golf ball of this embodiment, the surface coverage of the dimples with respect to the surface area of the ball is about 83%, and the total volume of the dimples is 560 $mm^3$.

As shown above, the golf balls of these embodiments (the first and second embodiments) exhibit a distinctive and aesthetically pleasing appearance due to the dimple pattern composed largely of the above-described non-circular dimples. Moreover, the high surface coverage and good air resistance-lowering effect obtained even when a large number of non-circular dimples are placed on the surface of the ball enables the distance traveled by the ball to be improved.

The invention claimed is:

1. A golf ball comprising a ball surface having a plurality of non-circular dimples thereon, wherein mutually neighboring dimples have contour lines therebetween which are arranged so as to be substantially parallel and are separated by an interval of 0.05 to 1.0 mm, land areas defined by the substantially parallel contour lines have an outer surface which forms the outermost peripheral face of the ball, and the non-circular dimples have a non-circular shape with inside angles that are curved, wherein a plurality of circular dimples is present on the ball surface.

2. The golf ball of claim 1, which has a dimple surface coverage, based on the surface area of the ball, of at least 75%.

3. The golf ball of claim 1, wherein a number of the plurality of circular dimples is adjusted to a ratio of at least 2% but not more than 50% of a total number of dimples.

4. The golf ball of claim 1, wherein at least four but not more than seven non-circular dimples are present around each of the plurality of circular dimples.

5. The golf ball of claim 1, wherein a volume of the plurality of non-circular dimples as a proportion of a total volume of the ball, expressed as the ratio of a cumulative volume of the plurality of non-circular dimples enclosed between an imaginary sphere were the ball to have no dimples on its surface and the dimple recesses to a volume of the imaginary sphere were the ball to have no dimples on its surface is set in a range of at least 1.1% but not more than 1.7%.

6. A golf ball comprising a ball surface having a plurality of non-circular dimples thereon, wherein mutually neighboring dimples have contour lines therebetween which are arranged so as to be substantially parallel and are separated by an interval of 0.05 to 1.0 mm, land areas defined by the substantially parallel contour lines have an outer surface which forms the outermost peripheral face of the ball, and the non-circular dimples have a non-circular shape with inside angles that are curved, wherein the non-circular dimples having a non-circular shape with curved inside angles have, in the smallest curved portions thereof, a radius of curvature in a range of 0.1 to 3.0 mm.

7. The golf ball of claim 6, wherein a plurality of circular dimples is present on the ball surface.

8. The golf ball of claim 6, which has a dimple surface coverage, based on the surface area of the ball, of at least 75%.

9. The golf ball of claim 6, wherein the dimples on the ball surface have a cumulative volume, obtained by summing the volumes of the individual dimples below a flat plane circumscribed by the edge of each dimple, of from 400 to 750 $mm^3$.

10. The golf ball of claim 6, wherein a volume of the plurality of non-circular dimples as a proportion of a total volume of the ball, expressed as the ratio of a cumulative volume of the plurality of non-circular dimples enclosed between an imaginary sphere were the ball to have no dimples on its surface and the dimple recesses to a volume of the imaginary sphere were the ball to have no dimples on its surface is set in a range of at least 1.1% but not more than 1.7%.

11. A golf ball comprising a ball surface having a plurality of non-circular dimples thereon, wherein mutually neighboring dimples have contour lines therebetween which are arranged so as to be substantially parallel and are separated by an interval of 0.05 to 1.0 mm, land areas defined by the substantially parallel contour lines have an outer surface which forms the outermost peripheral face of the ball, and the non-circular dimples have a non-circular shape with inside angles that are curved, wherein the dimples on the ball surface have a cumulative volume, obtained by summing the volumes of the individual dimples below a flat plane circumscribed by the edge of each dimple, of from 400 to 750 $mm^3$.

12. The golf ball of claim 11, wherein a plurality of circular dimples is present on the ball surface.

13. The golf ball of claim 11, wherein the non-circular dimples having a non-circular shape with curved inside angles have, in the smallest curved portions thereof, a radius of curvature in a range of 0.1 to 3.0 mm.

14. The golf ball of claim 11, which has a dimple surface coverage, based on the surface area of the ball, of at least 75%.

15. The golf ball of claim 11, wherein a volume of the plurality of non-circular dimples as a proportion of a total volume of the ball, expressed as a ratio of a cumulative volume of the plurality of non-circular dimples enclosed between an imaginary sphere were the ball to have no dimples on its surface and the dimple recesses to a volume of the imaginary sphere were the ball to have no dimples on its surface is set in a range of at least 1.1% but not more than 1.7%.

16. A golf ball comprising a ball surface having a plurality of non-circular dimples thereon, wherein mutually neighboring dimples have contour lines therebetween which are arranged so as to be substantially parallel and are separated by an interval of 0.05 to 1.0 mm, land areas defined by the substantially parallel contour lines have an outer surface which forms the outermost peripheral face of the ball, and the non-circular dimples have a non-circular shape with inside angles that are curved, wherein a plurality of circular dimples is present on the ball surface, wherein the non-circular dimples having a non-circular shape with curved inside angles have, in the smallest curved portions thereof, a radius of curvature in a range of 0.1 to 3.0 mm; and wherein the dimples on the ball surface have a cumulative volume, obtained by summing the volumes of the individual dimples below a flat plane circumscribed by the edge of each dimple, of from 400 to 750 $mm^3$.

17. The golf ball of claim 16, which has a dimple surface coverage, based on the surface area of the ball, of at least 75%.

18. The golf ball of claim 16, wherein a number of the plurality of circular dimples is adjusted to a ratio of at least 2% but not more than 50% of a total number of dimples.

19. The golf ball of claim 16, wherein at least four but not more than seven non-circular dimples are present around each of the plurality of circular dimples.

20. The golf ball of claim 16, wherein a volume of the plurality of non-circular dimples as a proportion of a total volume of the ball, expressed as the ratio of a cumulative volume of the plurality of non-circular dimples enclosed between an imaginary sphere were the ball to have no dimples on its surface and the dimple recesses to a volume of the imaginary sphere were the ball to have no dimples on its surface is set in a range of at least 1.1% but not more than 1.7%.

* * * * *